US011671761B2

(12) United States Patent
Jin et al.

(10) Patent No.: US 11,671,761 B2
(45) Date of Patent: Jun. 6, 2023

(54) SOUNDING DEVICE

(71) Applicant: AAC Microtech (Changzhou) Co., Ltd., Changzhou (CN)

(72) Inventors: Xin Jin, Shenzhen (CN); Zhiwei Zhong, Shenzhen (CN); Fan Zhang, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 36 days.

(21) Appl. No.: 17/537,530

(22) Filed: Nov. 30, 2021

(65) Prior Publication Data

US 2022/0174418 A1 Jun. 2, 2022

(30) Foreign Application Priority Data

Nov. 30, 2020 (CN) ..... 202022829828.1

(51) Int. Cl.
*H04R 9/02* (2006.01)
*H04R 7/18* (2006.01)

(52) U.S. Cl.
CPC ..... *H04R 9/025* (2013.01); *H04R 7/18* (2013.01)

(58) Field of Classification Search
CPC . H04R 9/025; H04R 7/18; H04R 7/20; H04R 2400/11; H04R 2499/11; H04R 9/045; H04R 9/06; H04R 7/16; H04R 9/043
See application file for complete search history.

(56) References Cited

U.S. PATENT DOCUMENTS 11,570,534 B2 * 1/2023 Song ..... H04R 1/026
2020/0213763 A1 * 7/2020 Hu ..... H04R 9/025

FOREIGN PATENT DOCUMENTS

CN 110035362 A * 7/2019

* cited by examiner

*Primary Examiner* — Angelica M McKinney
(74) *Attorney, Agent, or Firm* — W&G Law Group

(57) ABSTRACT

Disclosed is a sounding device, including a frame, a vibration system, and a magnetic circuit system. The magnetic circuit system has a magnetic gap. The vibration system includes a diaphragm, a framework, a voice coil, and an elastic conductor. The elastic conductor includes an elastic conductor body, a first connecting piece and a second connecting piece, a first bending arm and a second bending aim, and a first pad and a second pad. The lead wires are connected to the first pad and the second pad, the first pad and the second pad are disposed on two sides of the framework, the first bending arm is spaced from the second bending arm, and a middle section is used to increase the volumes of first auxiliary magnets, thereby improving the acoustic performance of the sounding device.

10 Claims, 7 Drawing Sheets

A-A

SOUNDING DEVICE

TECHNICAL FIELD

The present invention relates to electro-acoustic transducers, and in particular to a sounding device.

BACKGROUND ART

With the advent of the Internet era, the number of mobile terminal devices is continuously increasing. Among mobile devices, mobile phones are undoubtedly the most common and most portable mobile terminal devices. Sounding devices for playing sound, such as music, are widely used in mobile terminal devices such as mobile phones, vibration systems in the sounding devices are particularly important, and the entire sounding device vibrates and generates sound through the vibration system.

A sounding device in the related art comprises a frame, a vibration system fixed to the frame, and a magnetic circuit system for driving the vibration system to vibrate and generate sound, wherein the magnetic circuit system has a magnetic gap, and the vibration system comprises a diaphragm fixed to the frame, a voice coil inserted into the magnetic gap for driving the diaphragm to vibrate, a framework connected to the diaphragm and supporting and suspending the voice coil below the diaphragm, and an elastic conductor connected to the side of the framework away from the diaphragm, and the voice coil comprises lead wires electrically connected to the elastic conductor; and the magnetic circuit system comprises a yoke and a magnet fixed to the yoke, and the magnet comprises a main magnet and auxiliary magnets forming a magnetic gap with the main magnet.

However, in the related art, the design of the elastic conductor is not very reasonable, resulting in a pad being disposed at a middle area of the framework, which limits the areas of the auxiliary magnets, such that the sounding device has poor acoustic performance.

Therefore, there is a need to provide a new sounding device to solve the above problems.

SUMMARY OF THE INVENTION

The object of the present invention is to provide a sounding device having pads at two side areas of a framework, auxiliary magnets of large volumes, and good acoustic performance.

In order to achieve the above object, the present invention provides a sounding device, comprising a frame, a vibration system fixed to the frame separately, and a magnetic circuit system configured to drive the vibration system to vibrate to produce sound, wherein the magnetic circuit system has a magnetic gap, the vibration system comprises a diaphragm fixed to the frame, a voice coil inserted into the magnetic gap to drive the diaphragm to vibrate, a framework connected to the diaphragm, and an elastic conductor fixed to the frame and connected to one side of the framework away from the diaphragm, one side of the voice coil has lead wires, and the framework and the voice coil define a receiving space, wherein the elastic conductor comprises an elastic conductor body fixed to the frame, a first connecting piece and a second connecting piece that bend and extend from the elastic conductor body toward each other respectively, a first bending arm bending and extending from the first connecting piece toward the receiving space along the framework, a second bending arm bending and extending from the second connecting piece toward the receiving space along the framework, and a first pad and a second pad that are formed by extending the first bending arm and the second bending arm in directions away from each other respectively; the first pad and the second pad are disposed on two sides of the framework respectively; and the first bending arm is spaced from the second bending arm, and the lead wires are fixedly and electrically connected to the first pad and the second pad respectively.

Optionally, the framework comprises a bottom wall fixed to the diaphragm and a sidewall bending and extending in a direction from the bottom wall to the magnetic circuit system, and one end of the sidewall away from the diaphragm is fixedly connected to the first connecting piece and the second connecting piece.

Optionally, the bottom wall has a ring shape, and the sidewall comprises a first sidewall bending and extending in a direction from the outer periphery of the bottom wall to the magnetic circuit system and a second sidewall bending and extending in a direction from the inner periphery of the bottom wall to the magnetic circuit system; and the first sidewall is connected to the first connecting piece and the second connecting piece, the second sidewall is connected to the voice coil, the first sidewall is spaced from and opposite to the voice coil, and the bottom wall, the first sidewall, the second sidewall, and the voice coil define the receiving space.

Optionally, the first connecting piece comprises a first elastic portion protruding from the elastic conductor body and a first connecting portion bending and extending from the first elastic portion to the second connecting piece; the second connecting piece comprises a second elastic portion protruding from the elastic conductor body and a second connecting portion bending and extending from the second elastic portion to the first connecting piece; and the first connecting piece is spaced from the second connecting piece, and the first connecting portion and the second connecting portion are both connected to one end of the first sidewall away from the diaphragm.

Optionally, the first pad and the second pad are both fixedly connected to one side of the bottom wall away from the diaphragm.

Optionally, the voice coil has a racetrack shape and comprises a pair of minor-axis sides and a pair of major-axis sides, the at least one first sidewall comprises two first sidewalls that are spaced apart from each other and that are respectively located on the pair of minor-axis sides of the voice coil, and the second sidewall is ring-shaped and connected to one end of the voice coil close to the diaphragm.

Optionally, the first bending arm comprises a first bending portion close to the first sidewall and a second bending portion bending and extending from the first bending portion, and the second bending portion is fixed to one side of the bottom wall away from the diaphragm; the second bending arm comprises a third bending portion close to the first sidewall and a fourth bending portion bending and extending from the third bending portion, and the fourth bending portion is fixed to one side of the bottom wall away from the diaphragm; and the first pad is formed by extending the second bending portion away from the fourth bending portion, and the second pad is formed by extending the fourth bending portion away from the second bending portion.

Optionally, the magnetic circuit system comprises a yoke, a main magnet disposed on the yoke, first auxiliary magnets and second auxiliary magnets that are disposed around the main magnet, and an auxiliary magnetic conduction plate fixed to the first auxiliary magnets and the second auxiliary magnets, the first auxiliary magnets are located on the minor-axis sides of the voice coil and comprise a magnet body and an extension portion extending from the magnet body; and the first sidewall is provided with a first avoiding notch, and the extension portion protrudes from the first avoiding notch and is located between the first connecting piece and the second connecting piece.

Optionally, the auxiliary magnetic conduction plate is formed with avoiding portions at positions corresponding to the first pad and the second pad.

Optionally, the vibration system further comprises an auxiliary diaphragm attached to one side of the elastic conductor away from the diaphragm; and the auxiliary diaphragm is provided with a second avoiding notch, and the first avoiding opening communicates with the second avoiding opening to accommodate the extension portion.

Compared with the related art, in the sounding device of the present invention, the elastic conductor comprises an elastic conductor body fixed to the frame, a first connecting piece and a second connecting piece that bend and extend from the elastic conductor body toward each other respectively, a first bending arm bending and extending from the first connecting piece toward the receiving space along the framework, a second bending arm bending and extending from the second connecting piece toward the receiving space along the framework, and a first pad and a second pad that are formed by extending the first bending arm and the second bending arm in directions away from each other respectively; lead wires of the voice coil are fixedly and electrically connected to the first pad and the second pad respectively; the first pad and the second pad are both disposed on two sides of the framework, and the first bending arm is spaced from the second bending arm, such that an extension portion on the first auxiliary magnets can extend between the first connecting piece and the second connecting piece through the interval between the first bending arm and the second bending arm. With the extension portion disposed on the first auxiliary magnets, the volume of the first auxiliary magnets is increased, thereby improving the acoustic performance of the sounding device.

BRIEF DESCRIPTION OF THE DRAWINGS

To illustrate the technical solutions in the embodiments of the present invention more clearly, a brief introduction to the accompanying drawings required for describing the embodiments will be made below. Obviously, the accompanying drawings in the following description show merely some embodiments of the present invention, and those of ordinary skills in the art may derive other drawings from these accompanying drawings without any creative effort, in which.

DETAILED DESCRIPTION OF EMBODIMENTS

The technical solutions in the embodiments of the present invention will be described clearly and completely below in conjunction with the accompanying drawings for the embodiments of the present invention; and obviously, the embodiments described are merely some, rather than all, of the embodiments of the present invention. All other embodiments obtained by those of ordinary skills in the art based on the embodiments of the present invention without any creative efforts shall all fall within the protection scope of the present invention.

Figure 1:
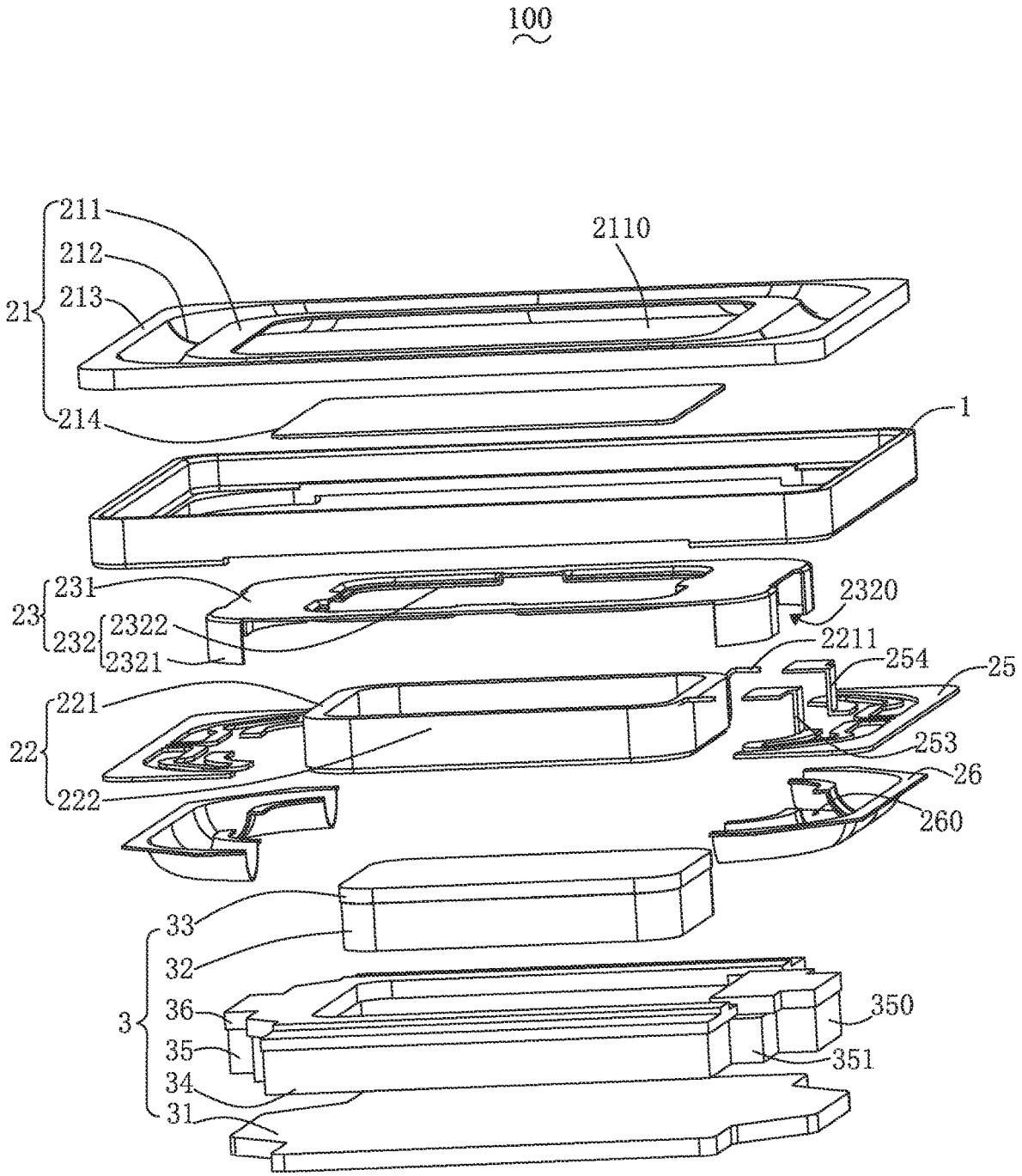
FIG. 1 is an isometric and exploded view of a three-dimensional structure of a sounding device according to the present invention.
Figure 2:
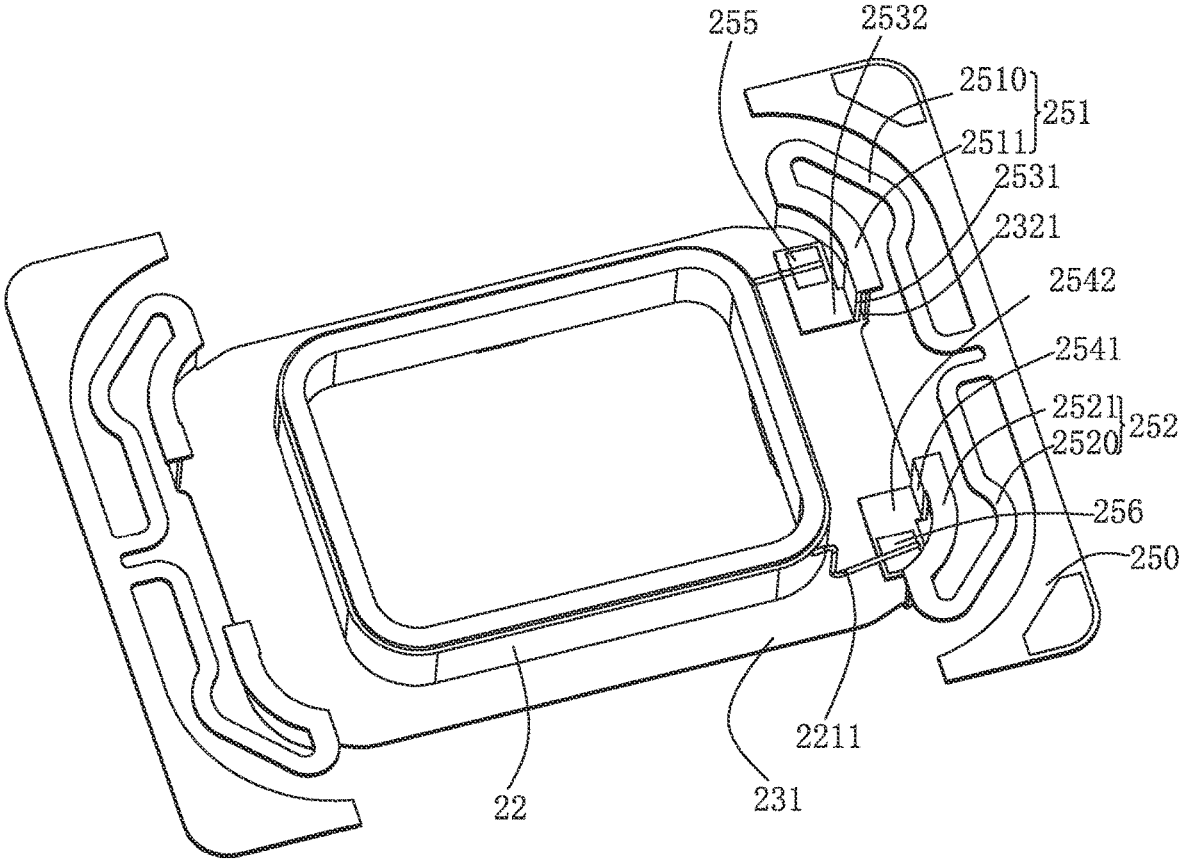
FIG. 2 is an isometric view of an assembly of a voice coil, a framework, and an elastic conductor of the sounding device according to the present invention.
Figure 3:
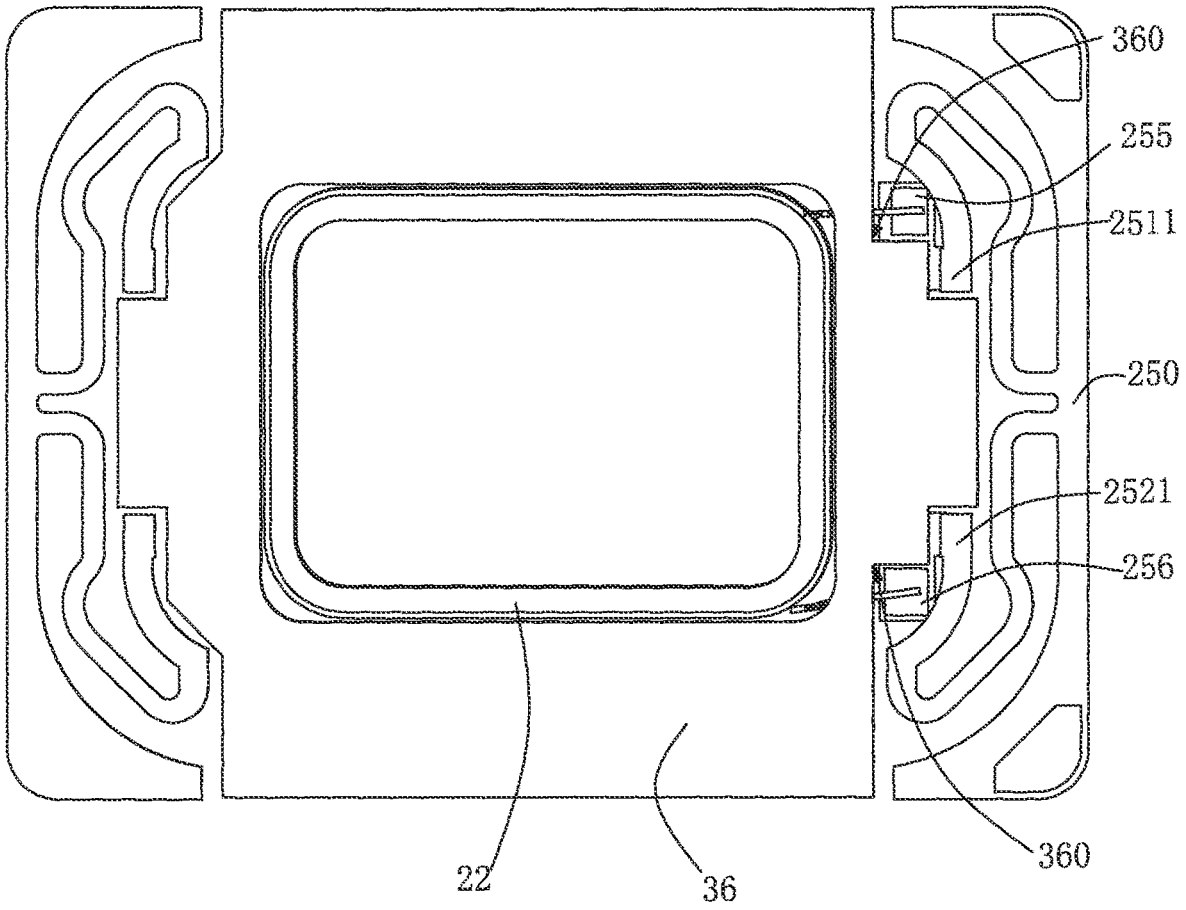
FIG. 3 is a schematic view of a three-dimensional structure for an auxiliary magnetic conduction plate and the elastic conductor of the sounding device according to the present invention.
Figure 4:
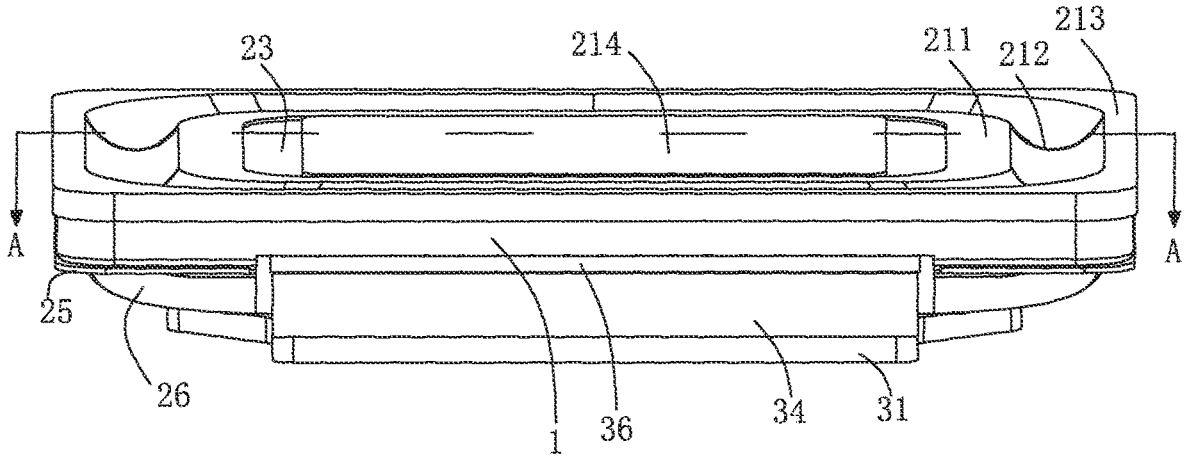
FIG. 4 is a schematic view of a three-dimensional structure of the sounding device according to the present invention.
Figure 5:
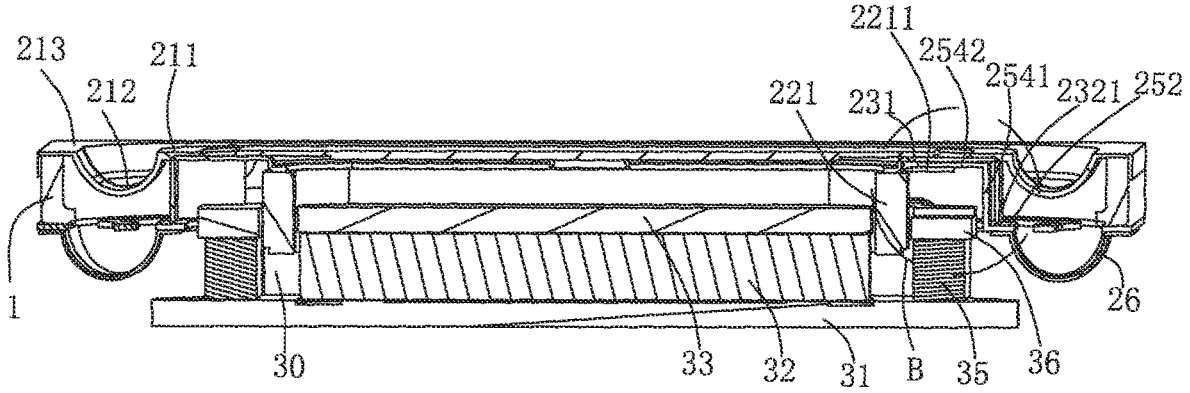
FIG. 5 is a cross-sectional view of the sounding device along the line A-A in FIG. 3 according to the present invention.
Figure 6:
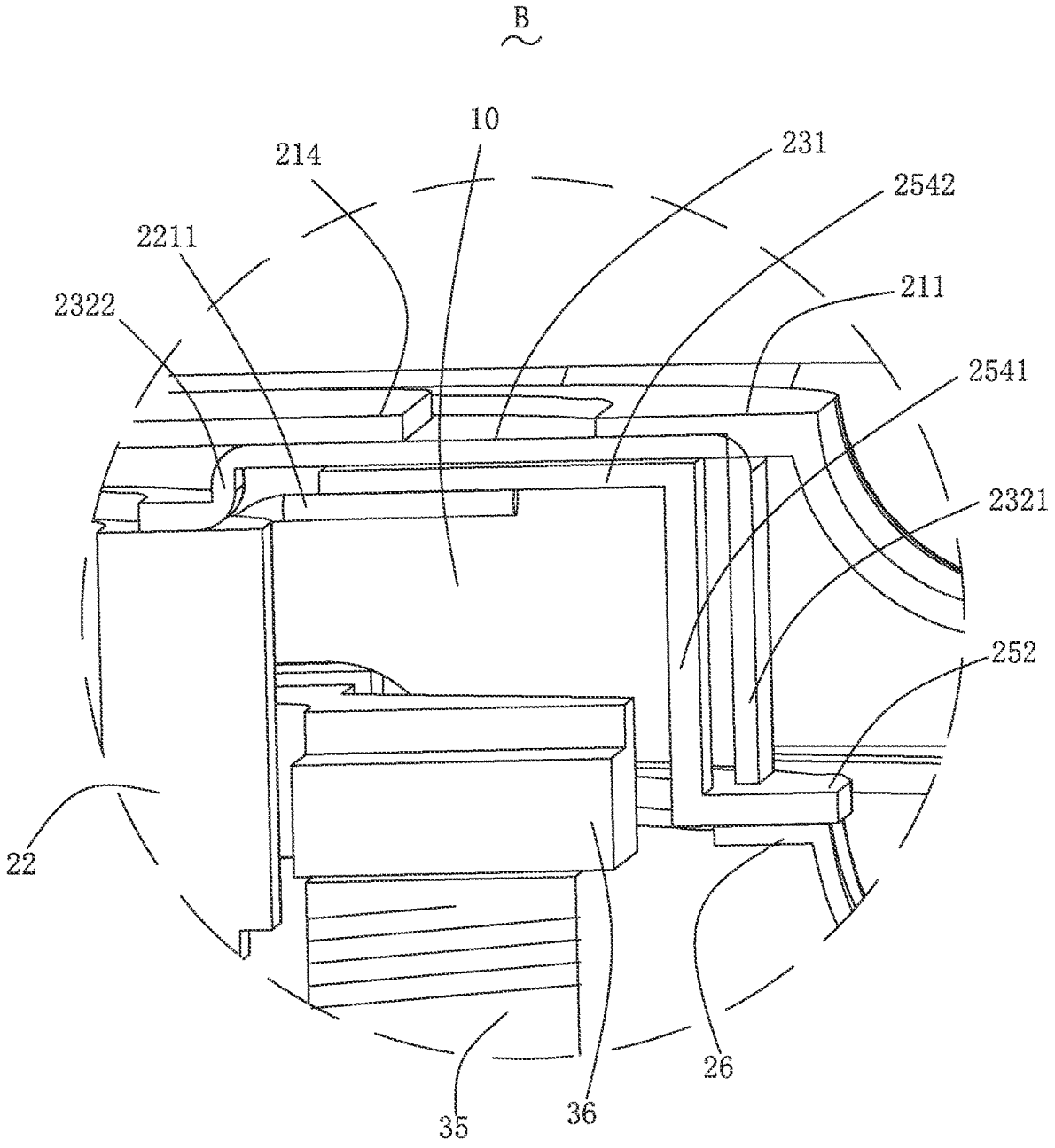
FIG. 6 is an enlarged view of Part B in FIG. 4 of the sounding device according to the present invention.
Figure 7:
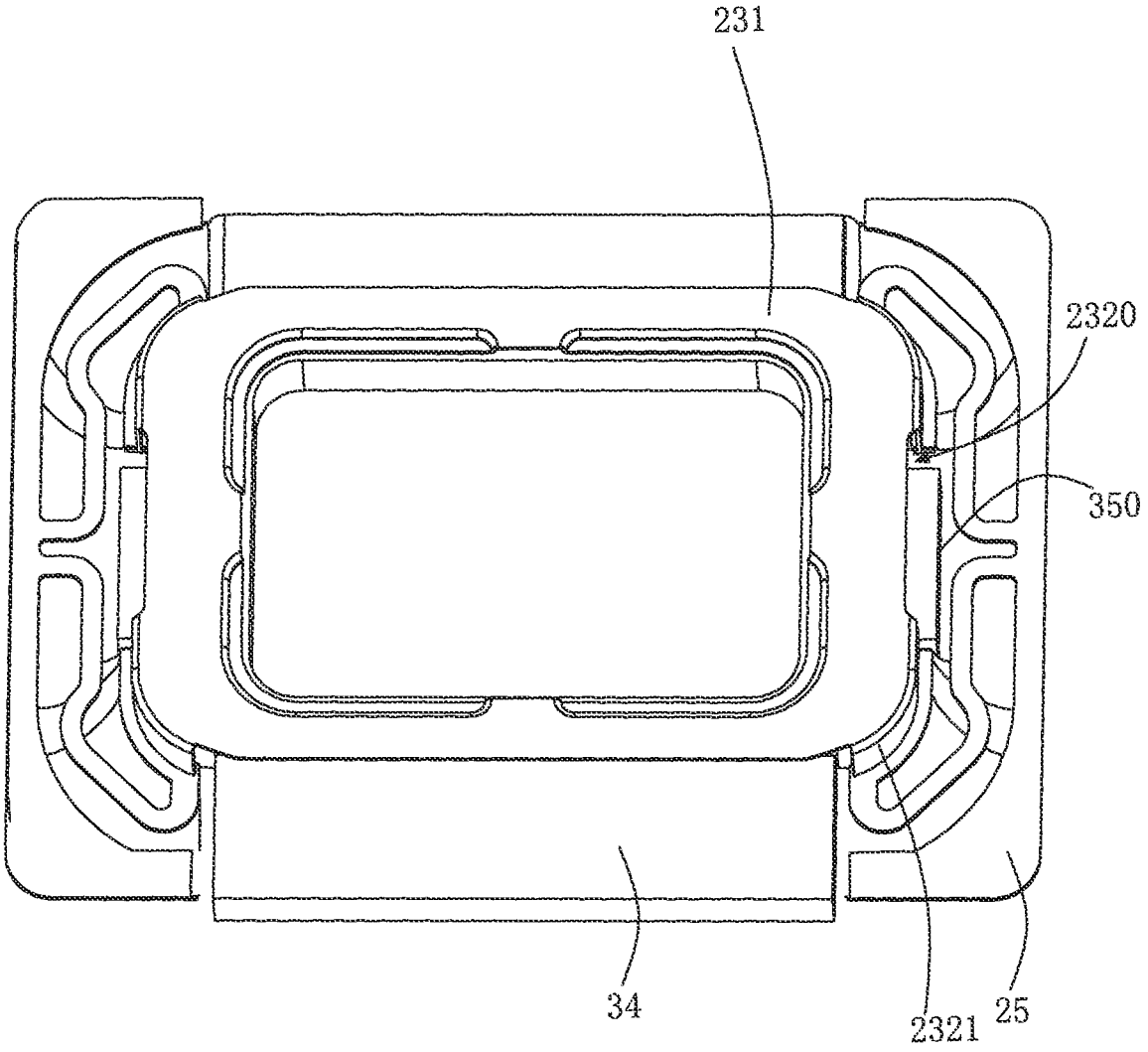
FIG. 7 illustrates partial assembly of the sounding device according to the present invention.

Referring to FIGS. 1-7, the present invention provides a sounding device 100. The sounding device 100 comprises a frame 1, a vibration system fixed to the frame 1 separately, and a magnetic circuit system 3 for driving the vibration system to vibrate and generate sound, wherein the magnetic circuit system 3 has a magnetic gap 30.

Specifically, the vibration system comprises a diaphragm 21 fixed to the frame 1, a voice coil 22 inserted into the magnetic gap 30 for driving the diaphragm 21 to vibrate, a framework 23 connected to the diaphragm 21, an elastic conductor 25 fixed to the frame 1 and connected to the side of the framework 23 away from the diaphragm 21, and an auxiliary diaphragm 26. The framework 23 and the voice coil 22 together enclose a receiving space 10.

The diaphragm 21 comprises a vibration portion 211 having a through hole 2110, a suspension portion 212 extending from the periphery of the vibration portion 211 and surrounding the vibration portion 211, and a fixed portion 213 bending and extending from the suspension portion 212 to the side away from the vibration portion 211 and fixed to the frame 1, and a dome 214. The vibration portion 211 surrounds and is spaced from the dome 214.

The voice coil 22 has a racetrack shape, with one end away from the diaphragm 21 inserted into the magnetic gap 30, and comprises a pair of minor-axis sides 221 that are spaced from each other and a pair of major-axis sides 222 that are spaced from each other. The minor-axis sides 221 have two lead wires 2211.

The framework 23 comprises a bottom wall 231 that is fixed to the vibration portion 211 and has a ring shape, and a sidewall 232 that bends and extends in a direction from the bottom wall 231 to the magnetic circuit system 3.

Specifically, the sidewall 232 comprises a first sidewall 2321 bending and extending in a direction from the outer periphery of the bottom wall 231 to the magnetic circuit system 3 and a second sidewall 2322 bending and extending in a direction from the inner periphery of the bottom wall 231 to the magnetic circuit system 3. There are two first sidewalls 2321, which are disposed on two opposite sides of short shafts of the voice coil 22 in a spaced manner, and the second sidewall 2322 has a ring shape and is connected to one end of the voice coil 22 that is close to the diaphragm 21.

The first sidewall 2321 is spaced from and opposite to the voice coil 22, and the bottom wall 231, the first sidewall 2321, the second sidewall 2322, and the voice coil 22 together enclose the receiving space 10. The first sidewall 2321 is provided with a first avoiding notch 2320 formed by removing material from the first sidewall 2321.

Specifically, the bottom wall 231 is located between the dome 214 and the vibration portion 211 and connects the vibration portion 211 and the dome 214 to form an integral structure, which is more reliable.

There are two elastic conductors 25, which are disposed on two minor-axis sides 221 of the voice coil 22 respectively. The elastic conductor 25 comprises an elastic conductor body 250 fixed to the frame 1, a first connecting piece 251 and a second connecting piece 252 that extend from the elastic conductor body 250 toward each other respectively, a first bending arm 253 bending and extending from the first connecting piece 251 toward the receiving space 10 along the framework 23, a second bending arm 254 bending and extending from the second connecting piece 252 toward the receiving space 10 along the framework, and a first pad 255 and a second pad 256 that are formed by extending the first bending arm 253 and the second bending arm 254 in directions away from each other respectively. The first connecting piece 251 is spaced from the second connecting piece 252, the first bending arm 253 is spaced from the second bending arm 254, the first connecting piece 251 comprises a first elastic portion 2510 protruding from the elastic conductor body 250 and a first connecting portion 2511 bending and extending from the first elastic portion 2510 to the second connecting piece 252, and the second connecting piece 252 comprises a second elastic portion 2520 protruding from the elastic conductor body 250 and a second connecting portion 2521 bending and extending from the second elastic portion 2520 to the first connecting piece 251. The first elastic portion 2510 is spaced from the second elastic portion 2520. The first connecting portion 2511 and the second connecting portion 2521 extend toward each other and are spaced from each other, and both connected to one end of the first sidewall 2321 away from the diaphragm 21. In this embodiment, it can be understood that since the voice coil 22 has lead wires on only one side, the other elastic conductor 25 may also not be provided with a bending arm and a third connecting piece.

Specifically, the first bending arm 253 comprises a first bending portion 2531 that bends and extends in a direction from the first connecting portion 2511 to the bottom wall 231 along the first sidewall 2321 and is located in the receiving space 10 and a second bending portion 2532 that bends and extends in a direction from the first bending portion 2531 to the second sidewall 2322, the second bending arm 254 comprises a third bending portion 2541 that bends and extends in a direction from the second connecting portion 2521 to the bottom wall 231 along the first sidewall 2321 and is located in the receiving space 10 and a fourth bending portion 2542 that bends and extends in a direction from the third bending portion 2541 to the second sidewall 2322, the first pad 255 is formed by extending the second bending portion 2532 away from the fourth bending portion 2542, the second pad 256 is formed by extending the fourth bending portion 2542 away from the second bending portion 2532, and the two lead wires 2211 of the voice coil 22 are connected to the first pad 255 and the second pad 256 in an electrically welded manner. The first bending portion 2531 and the third bending portion 2541 are both spaced from and parallel to the first sidewall 2321; the second bending portion 2532, the fourth bending portion 2542, the first pad 255, and the second pad 256 are all attached to the side of the bottom wall 231 close to the voice coil 22; and the first pad 255 and the second pad 256 are disposed at two side areas of the framework 23 respectively.

The elastic conductor body 250 is fixed to the side of the frame 1 away from the diaphragm 21, and the first connecting piece 251 and the second connecting piece 252 are spaced from each other and fixed to the side of the first sidewall 2321 away from the diaphragm 21.

The auxiliary diaphragm 26 is attached to the side of the elastic conductor 25 away from the diaphragm 21. The auxiliary diaphragm is provided with a second avoiding notch 260, and the second avoiding notch 260 communicates with the first avoiding notch 2320.

The magnetic circuit system 3 comprises an yoke 31, a main magnet 32, a main magnetic conduction plate 33, two second auxiliary magnets 34, two first auxiliary magnets 35, and an auxiliary magnetic conduction plate 36. The main magnet 32 is mounted on the side of the yoke 31 close to the frame 1, the main magnetic conduction plate 33 is mounted on the side of the main magnet 32 close to the frame 1, the second auxiliary magnets 34 and the first auxiliary magnets 35 are mounted on the side of the yoke 31 close to the frame 1 and spaced from the main magnet 32, the auxiliary magnetic conduction plate 36 is mounted on the side of the second auxiliary magnets 34 and the first auxiliary magnets 35 close to the frame 1 and spaced from the main magnetic conduction plate 33, and the side of the auxiliary magnetic conduction plate 36 away from the yoke 31 is fixed to the frame 1. Specifically, the main magnet 32 is approximately a cuboid with short shafts and long shafts. The two second auxiliary magnets 34 correspond to the long shafts of the main magnet 32. The two first auxiliary magnets 35 both correspond to the short shafts of the main magnet 32. The second auxiliary magnets 34 and the first auxiliary magnets 35 are all spaced from the main magnet 32 to form a magnetic gap 30. One end of the voice coil 24 away from the diaphragm 21 is inserted into the magnetic gap 30. The two first auxiliary magnets 35 are cuboids. The first auxiliary magnet 35 comprises a magnet body 351 and an extension portion 350 that extends away from the main magnet 32. The extension portion 350 protrudes from the first avoiding notch 2320 and is located between the first connecting piece 251 and the second connecting piece 252, and is received in the second avoiding notch 260. The design of the extension portion 350 increases the volumes of the first auxiliary magnets 35, thereby improving the acoustic performance of the sounding device 100.

The auxiliary magnetic conduction plate 36 is provided with avoiding portions 360 at corresponding positions of the first pad 255 and the second pad 256, and the first pad 255, the second pad 256, and the avoiding portions 360 are all disposed to be closed to two side areas of the framework 23, which is beneficial to realize the maximization of linearly regional magnetic conduction, thereby improving the acoustic performance of the sounding device.

Compared with the related art, in the sounding device of the present invention, the elastic conductor comprises an elastic conductor body fixed to the frame, a first connecting piece and a second connecting piece that bend and extend from the elastic conductor body toward each other respectively, a first bending arm bending and extending from the first connecting piece toward the receiving space along the framework, a second bending arm bending and extending from the second connecting piece toward the receiving space along the framework, and a first pad and a second pad that are formed by extending the first bending arm and the second bending arm outward away from each other respectively; lead wires of the voice coil are fixedly and electrically connected to the first pad and the second pad respectively; the first pad and the second pad are both disposed close to two sides of the framework, and the first bending arm is spaced from the second bending arm, such that an extension portion on the first auxiliary magnets can extend between the first connecting piece and the second connecting piece through the interval between the first bending arm and the second bending arm. With the extension portion disposed on the first auxiliary magnets, the volumes of the first auxiliary magnets are increased, thereby improving the acoustic performance of the sounding device.

The above descriptions provided in the present invention are merely embodiments of the present invention, and not intended to limit the patent scope of the present invention thereby, and any equivalent structure or equivalent process variations made by using the contents of the description and accompanying drawings are applied directly or indirectly in other relevant technical fields and also included in the scope of patent protection of the present invention.

What is claimed is:

1. A sounding device, comprising:

a frame, a vibration system fixed to the frame, and a magnetic circuit system configured to drive the vibration system to vibrate to produce sound, wherein the magnetic circuit system has a magnetic gap, the vibration system comprises a diaphragm fixed to the frame, a voice coil inserted into the magnetic gap to drive the diaphragm to vibrate, a framework connected to the diaphragm, and an elastic conductor fixed to the frame and connected to one side of the framework away from the diaphragm, one side of the voice coil has lead wires, and the framework and the voice coil define a receiving space, wherein the elastic conductor comprises an elastic conductor body fixed to the frame, a first connecting piece and a second connecting piece that bend and extend from the elastic conductor body toward each other respectively, a first bending arm bending and extending from the first connecting piece toward the receiving space along the framework, a second bending arm bending and extending from the second connecting piece toward the receiving space along the framework, and a first pad and a second pad that are formed by extending the first bending arm and the second bending arm in directions away from each other respectively; the first pad and the second pad are disposed on two sides of the framework respectively; and the first bending arm is spaced from the second bending arm, and the lead wires are fixedly and electrically connected to the first pad and the second pad respectively.

2. The sounding device as described in claim 1, wherein the framework comprises a bottom wall fixed to the diaphragm and a sidewall bending and extending in a direction from the bottom wall to the magnetic circuit system, and one end of the sidewall away from the diaphragm is fixedly connected to the first connecting piece and the second connecting piece.

3. The sounding device as described in claim 2, wherein the bottom wall has a ring shape, and the sidewall comprises a first sidewall bending and extending in a direction from the outer periphery of the bottom wall to the magnetic circuit system and a second sidewall bending and extending in a direction from the inner periphery of the bottom wall to the magnetic circuit system; and the first sidewall is connected to the first connecting piece and the second connecting piece, the second sidewall is connected to the voice coil, the first sidewall is spaced from and opposite to the voice coil, and the bottom wall, the first sidewall, the second sidewall, and the voice coil define the receiving space.

4. The sounding device as described in claim 3, wherein the first connecting piece comprises a first elastic portion protruding from the elastic conductor body and a first connecting portion bending and extending from the first elastic portion to the second connecting piece; the second connecting piece comprises a second elastic portion protruding from the elastic conductor body and a second connecting portion bending and extending from the second elastic portion to the first connecting piece; and the first connecting piece is spaced from the second connecting piece, and the first connecting portion and the second connecting portion are both connected to one end of the first sidewall away from the diaphragm.

5. The sounding device as described in claim 4, wherein the first pad and the second pad are both fixedly connected to one side of the bottom wall away from the diaphragm.

6. The sounding device as described in claim 5, wherein the voice coil has a racetrack shape and comprises a pair of minor-axis sides and a pair of major-axis sides, the at least one first sidewall comprises two first sidewalls that are spaced apart from each other and that are respectively located on the pair of minor-axis sides of the voice coil, and the second sidewall is ring-shaped and connected to one end of the voice coil close to the diaphragm.

7. The sounding device as described in claim 6, wherein the first bending arm comprises a first bending portion close to the first sidewall and a second bending portion bending and extending from the first bending portion, and the second bending portion is fixed to one side of the bottom wall away from the diaphragm; the second bending aim comprises a third bending portion close to the first sidewall and a fourth bending portion bending and extending from the third bending portion, and the fourth bending portion is fixed to one side of the bottom wall away from the diaphragm; and the first pad is formed by extending the second bending portion away from the fourth bending portion, and the second pad is formed by extending the fourth bending portion away from the second bending portion.

8. The sounding device as described in claim 7, wherein the magnetic circuit system comprises an yoke, a main magnet disposed on the yoke, first auxiliary magnets and second auxiliary magnets that are disposed around the main magnet, and an auxiliary magnetic conduction plate fixed to the first auxiliary magnets and the second auxiliary magnets, the first auxiliary magnets are located on the minor-axis sides of the voice coil and comprise a magnet body and an extension portion extending from the magnet body; and the first sidewall is provided with a first avoiding notch, and the extension portion protrudes from the first avoiding notch and is located between the first connecting piece and the second connecting piece.

9. The sounding device as described in claim 8, wherein the auxiliary magnetic conduction plate is formed with avoiding portions at positions corresponding to the first pad and the second pad.

10. The sounding device as described in claim 9, wherein the vibration system further comprises an auxiliary diaphragm attached to one side of the elastic conductor away from the diaphragm; and the auxiliary diaphragm is provided with a second avoiding notch, and the first avoiding opening communicates with the second avoiding opening to accommodate the extension portion.

* * * * *